US008547411B2

(12) United States Patent
Nagamine et al.

(10) Patent No.: US 8,547,411 B2
(45) Date of Patent: Oct. 1, 2013

(54) EXPOSURE DEVICE, LED HEAD AND IMAGE FORMING DEVICE

(75) Inventors: Masamitsu Nagamine, Tokyo (JP); Yo Kishikawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 105 days.

(21) Appl. No.: 13/233,391

(22) Filed: Sep. 15, 2011

(65) Prior Publication Data

US 2012/0075403 A1 Mar. 29, 2012

(30) Foreign Application Priority Data

Sep. 24, 2010 (JP) ..... 2010-213477

(51) Int. Cl.
*B41J 15/14* (2006.01)
*B41J 27/00* (2006.01)

(52) U.S. Cl.
USPC ..... 347/242; 347/257

(58) Field of Classification Search
USPC ..... 347/230, 238, 241, 242, 256–258, 347/244
See application file for complete search history.

(56) References Cited

FOREIGN PATENT DOCUMENTS

| | | | |
|---|---|---|---|
| JP | 11266037 A | * | 9/1999 |
| JP | A-2009-073041 | | 4/2009 |
| JP | 2010064426 A | * | 3/2010 |

* cited by examiner

*Primary Examiner* — Hai C Pham
(74) *Attorney, Agent, or Firm* — Posz Law Group, PLC

(57) ABSTRACT

An exposure device includes: a substrate on which a plurality of light emitting elements are mounted; an optical system that converges light irradiated from the light emitting elements onto a photosensitive surface; a holding member that holds and fixes the substrate; a support member that supports the optical system and the holding member; a first adhesive member that is provided between the substrate and the holding member; and a second adhesive member that is provided between the holding member and the support member, wherein the first adhesive member has higher elongation and lower hardness than the second adhesive member.

23 Claims, 10 Drawing Sheets

○: Warping 0–10 μm in longitudinal direction, 0–20 μm in lateral direction
Δ: Warping 10–10 μm in longitudinal direction, 20–30 μm in lateral direction
×: Warping 20 μm or more in longitudinal direction, 30 μm or more in lateral direction

EXPOSURE DEVICE, LED HEAD AND IMAGE FORMING DEVICE

CROSS REFERENCE TO RELATED APPLICATION

The present application is related to, claims priority from and incorporates by reference Japanese patent application No. 2010-213477, filed on Sep. 24, 2010.

TECHNICAL FIELD

The present application relates to an exposure device in which a substrate on which light emitting elements are mounted is fixed by an adhesive, a light emitting diode (LED) head and an image forming device.

BACKGROUND

Conventionally, an exposure device, an LED head and an image forming device include a substrate on which an LED array chip is mounted, a lens holder that supports the substrate, a rod lens array that is supported in the lens holder to face the LED array chip and that converges light irradiated from the LED array chip, a base arranged on an opposite side of a substrate mount surface, and the like. The electrostatic latent image is formed as the light irradiated from the LED array chip mounted on the substrate converges through the rod lens array and exposes the photosensitive drum arranged at an image forming position of the rod lens array. In this exposure device, a technology is known in which a mount surface is formed on the lens holder for supporting the substrate, in which both edges of the substrate contact the substrate mount surface, and in which the substrate is biased against the mount surface of the holder with a biasing member, in order to support the substrate in the lens holder.

Japanese Laid-Open Patent Application No. 2009-073041 discloses a technology to miniaturize an exposure device by engaging a first engagement part formed on a base and a second engagement part formed on an inner wall of a support member in order to assemble the base in the support member, thereby simplifying work to assemble the substrate in the support member.

However, in the conventional exposure device, LED head and image forming device, the substrate and the support member are deformed when the biasing member that biases the substrate is assembled, causing a center of the rod lens array and an optical axis of the LED array chip, which are supported in the support member, to become offset from each other. As a result, an uneven amount of light that exits from the rod lens array is generated, negatively affecting formation of latent image by the exposure device.

SUMMARY

An exposure device disclosed in the application includes: a substrate on which a plurality of light emitting elements are mounted; an optical system that converges light irradiated from the light emitting elements onto a photosensitive surface; a holding member that holds and fixes the substrate; a support member that supports the optical system and the holding member; a first adhesive member that is provided between the substrate and the holding member; and a second adhesive member that is provided between the holding member and the support member, wherein the first adhesive member has higher elongation and lower hardness than the second adhesive member.

A light emitting diode (LED) head disclosed in the application may include: a substrate on which a plurality of light emitting elements are mounted; an optical system that converges light irradiated from the light emitting elements onto a photosensitive surface, a holding member that holds and fixes the substrate; a support member that supports the optical system and the holding member; a first adhesive member that is provided between the substrate and the holding member; and a second adhesive member that is provided between the holding member and the support member, wherein the first adhesive member has higher elongation and lower hardness than the second adhesive member. An image forming device disclosed in the application may include the exposure device above.

Further, an image forming device disclosed in the application may includes the exposure device or the LED head above.

According to the exposure device, the LED head and the image forming device according to the present application, warping of the substrate can be suppressed within an acceptable range despite a change in environmental temperatures, and the substrate is stably held in the support member. A distance from a light emitting element mounted on the substrate that irradiates light to an entrance end surface of an optical system, an optical system of the light emitting element, and a center of the optical system is stably maintained. Therefore, an image forming device is provided that is capable of performing highly reliable and precise printing.

DETAILED DESCRIPTION OF EMBODIMENTS

Detailed description of embodiments becomes apparent when read in light of the explanation of preferred embodiments and accompanied drawings. However, the drawings are for explanation purposes only and are not intended to limit the scope of the invention.

Figure 2:
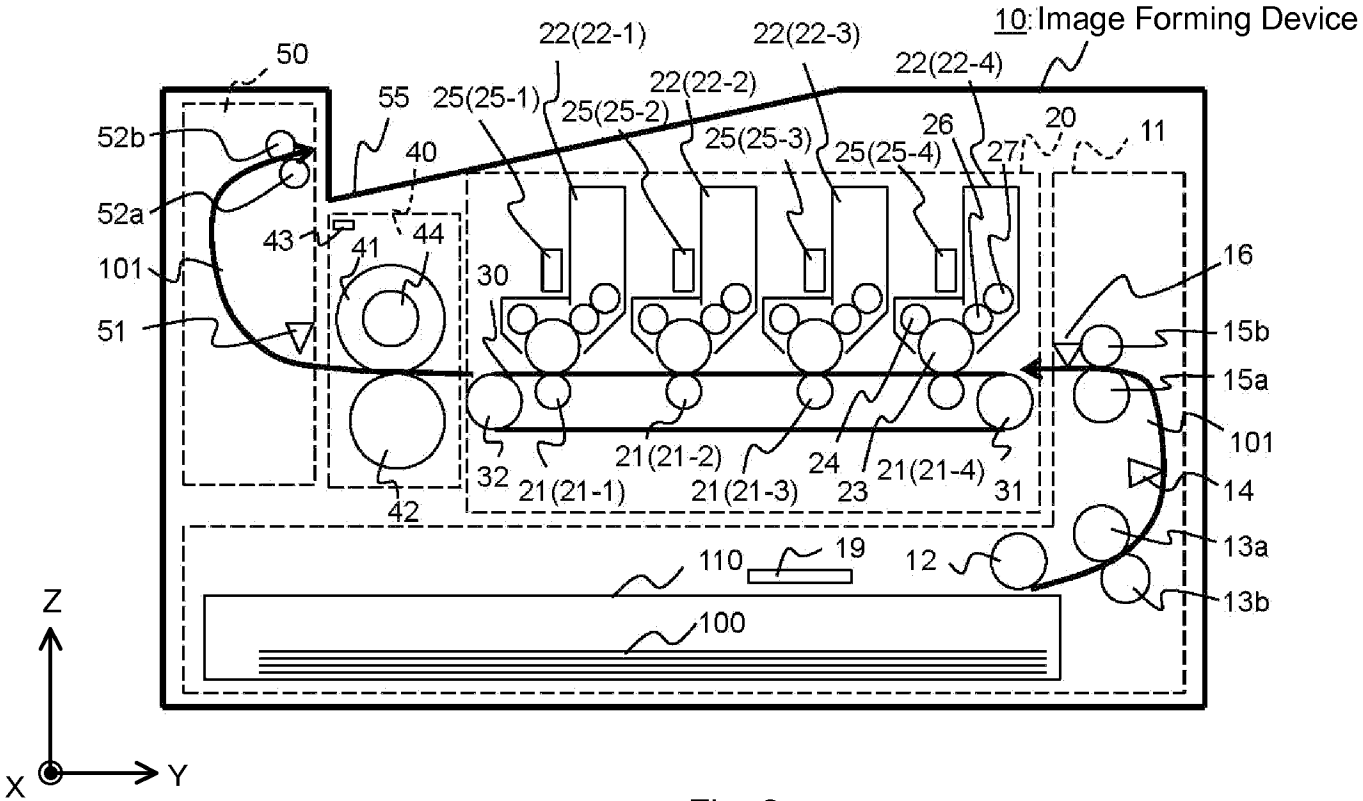
FIG. 2 is a schematic structural diagram illustrating an image forming device according to the first embodiment of the present application.

First Embodiment (Configuration of First Embodiment) FIG. 2 is a schematic structural diagram illustrating an image forming device according to a first embodiment of the present application.

An image forming device 10 is a tandem type printer device and includes a sheet supply part 11 that supplies a recording medium (e.g., recording sheet) 100, an image forming part 20 that forms a toner image on the recording sheet 100, a fuser 40 that fixes the toner image on the recording sheet 100, a sheet ejection part 50 that ejects the recording sheet 100, and a stacker 55 that stores the ejected recording sheet 100. In addition, the image forming device 10 includes motors (not shown) for rotating each roller, a clutch that turns on and off transmission of motive force to rollers of the carrying path 101, a high voltage power source that supplies a high voltage of 200 V to 5,000 V to a charge roller 24 and a transfer roller 21 in a image forming unit 22, and a low voltage power source that supplies 5 V direct current or 24 V direct current to circuits and motors.

The sheet supply part 11 includes a sheet storage cassette 110 installed in a lower part of the image forming device 10, recording sheets 100 stored in the sheet storage cassette 110, a hopping roller 12, a sheet supply roller 13*a* and a retard roller 13*b* for separating and taking out each recording sheet 100 from the sheet cassette 70, a sheet supply sensor 14, a pair of registration rollers 15*a* and 15*b*, a write position sensor 16, and a sheet color colorimetry part 19 that measures a color of the recording sheet 100.

The sheet storage cassette 110 is a cassette that stores a plurality of recording sheets 100 and is removably mounted on a lower part of the image forming device 10. The recording sheet 100 may be bond paper, recycled paper, gloss paper, matte paper, over-head-projector (OHP) films and the like.

The sheet color colorimetry part 19 measures a color of the recording sheet 100 stored in the sheet storage cassette 110.

The hopping roller 12 presses against, and rotates on, the recording sheet 100. The sheet supply roller 13*a* and the retard roller 13*b* are arranged on the downstream side of a carrying path 101 and face each other so as to sandwich the recording sheet 100. In a downstream side of the sheet supply roller 13*a* and the regard roller 13*b*, the sheet supply sensor 14 is provided.

The registration rollers 15*a* and 15*b* are arranged on the downstream side of the carrying path 101 of the sheet supply sensor 14 and face each other so as to sandwich the recording sheet 100. In a downstream side of the registration rollers 15*a* and 15*b*, the write position sensor 16 is provided. The registration roller 15*a* is driven by a registration motor (not shown).

The image forming part 20 includes image forming units 22 (22-1 to 22-4) provided in the order of black (K), yellow (Y), magenta (M) and cyan (C) from the right side of the drawing, and transfer rollers 21 (21-1 to 21-4) provided under the respective image forming units 22, rollers 31 and 32, and a carrying belt 30 that bridges between the rollers 31 and 32. Each of the image forming units 22 that correspond to black (K), yellow (Y), magenta (M) and cyan (C) includes a photosensitive body (e.g., photosensitive drum 23 that carries an electrostatic latent image based on image information, a charging roller 24 that charges the photosensitive drum 23, an LED head unit 25 that irradiates light corresponding to the image information onto a surface of the photosensitive drum 23, a development roller 26 that develops the electrostatic latent image on the surface of the photosensitive drum 23 by toner, a toner supply roller 27 that supplies the toner to the development roller 26, a removable toner cartridge 29, a toner restriction member (not shown), and a cleaning device (not shown) that scrapes off the toner remained on the photosensitive drum 23. The carrying belt 30 is a transfer body that carries the recording sheet 100 and transfers the toner image formed on the photosensitive drum 23 onto the recording sheet 100. The photosensitive drum 23 and the transfer roller 21 face each other via the carrying belt 30 and both contact the carrying belt.

The photosensitive drum 23 includes a photoconductive layer and a charge transportation layer on a conductive base layer that is formed from aluminum or the like. The photosensitive drum 23 is in a cylindrical shape and is arranged to be rotatably supported. The photosensitive drum 23 is in contact with the charging roller 24, the transfer roller 21, and the development roller 26, and is arranged so that a tip end of the cleaning device (not shown) contacts the photosensitive drum 23. The photosensitive drum 23 functions as an image carrier that carries the toner image by holding charges on the surface of the photosensitive drum 23 and rotates in the clockwise direction in the drawing. A configuration of the image forming unit 22 is described below based on the order in the rotational direction of the photosensitive drum 23.

In the charging roller 24, a conductive metal shaft is coated by a semi-conductive rubber, such as silicone or the like. The charging roller 24 has a cylindrical shape and is arranged to be pressed against the photosensitive drum 23 and rotatably supported. The charging roller 24 is charged by a high voltage power source (not shown) and applies a predetermined voltage to the photosensitive drum 23 by rotating while being pressed against the photosensitive drum 23. Thereby, the surface of the photosensitive drum 23 is uniformly charged.

The LED head unit 25 includes LED array chips 65, a rod lens array 62 and an LED drive element (not shown) and is arranged above the photosensitive drum 23. The LED head unit 25 irradiates light that corresponds to image information onto the surface of the photosensitive drum 23 and forms the electrostatic latent image on the surface of the photosensitive drum 23.

The toner supply roller 27 is formed by covering a conductive metal shaft with rubber. The supply roller 27 has a cylindrical shape and is arranged to contact the development roller 26. The toner supply roller 27 is charged by the high voltage power source (not shown), and by being pressed against the development roller 26, the toner is supplied to the development roller 26.

The development roller 26 is formed by covering a conductive metal shaft with a semiconductor urethane rubber or the like and is in a cylindrical shape. The development roller 26 is in contact with the toner supply roller 27 and the photosensitive drum 23 and is arranged so that a tip end of the toner restriction member (not shown) contacts the photosensitive drum 23. The development roller 26 is charged by the high voltage power source (not shown), and by being pressed against the toner supply roller 26, the toner is supplied to the development roller 26.

The toner restriction member (not shown) is formed by stainless steel or the like. The toner restriction member is in a plate shape and is arranged such that the tip end contacts the surface of the development roller 26. The toner restriction member (not shown) restricts the thickness of toner formed on the surface of the development roller 26 to become always uniform by scraping the excess toner on the surface of the development roller 26.

The cleaning device (not shown) is formed by a rubber material or the like. The cleaning device is in a plate shape and is arranged such that the tip end contacts the surface of the photosensitive drum 23. The cleaning device (not shown) cleans the photosensitive drum by scraping off the toner remaining on the photosensitive drum 23 after the toner image formed on the photosensitive drum 23 is transferred onto the recording sheet 100.

The fuser 40 includes a fusion roller 41, a backup roller 42, a temperature detection sensor 43 and a halogen heater 44. Inside the fusion roller 41, the halogen heater 44, which is typified by a halogen lamp, is provided. Above the fusion roller 41, the temperature detection sensor 43 that is configured by a thermister is provided to detect the surface temperature of the fusion roller 41.

The sheet ejection part 50 includes a sheet guideway sensor 51 and a pair of ejection rollers 52*a* and 52*b*. The ejection rollers 52*a* and 52*b* are arranged on the downstream side of the carrying path 101 of the fuser 40 to face each other so as to sandwich the recording sheet 100. The ejection rollers 52*a* and 53*b* are respectively driven by a motor (not shown).

Figure 1:
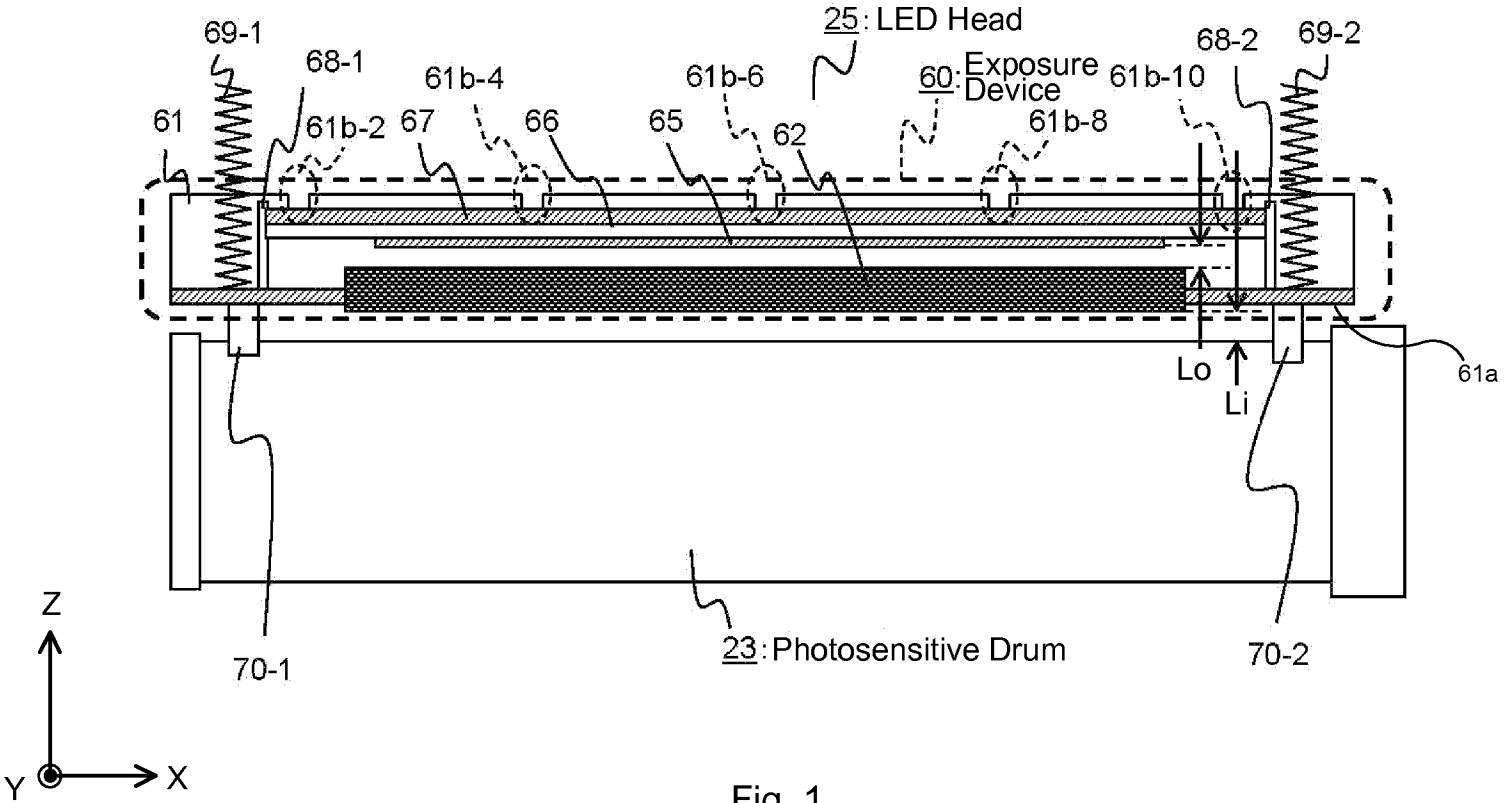
FIG. 1 is a longitudinal cross-sectional view illustrating an LED head and a photosensitive drum in a first embodiment of the present application. In the embodiment, the X-direction is referred to as the longitudinal direction, and the Y-direction is referred to as the lateral direction.
Figure 3:
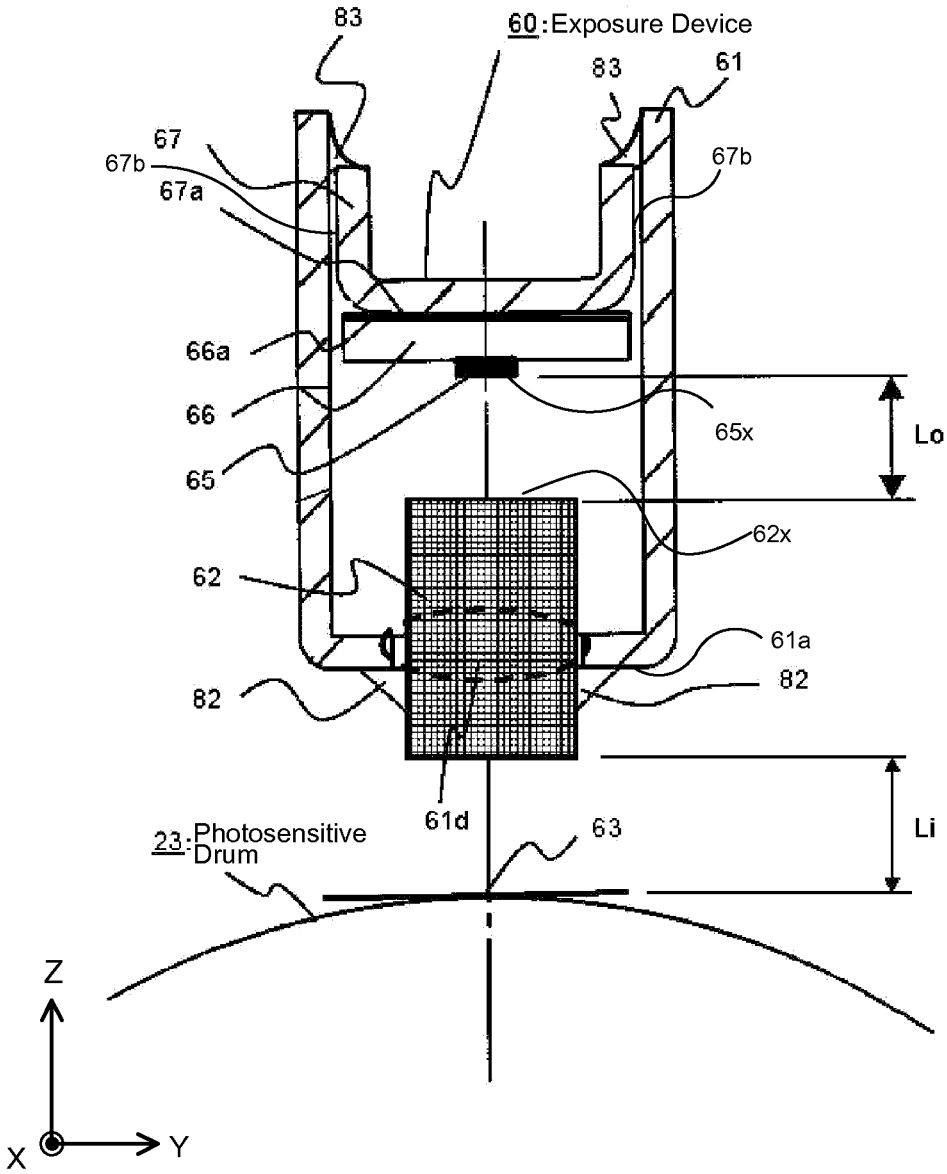
FIG. 3 is a lateral cross-sectional view illustrating an LED head and a photosensitive drum in the first embodiment of the present application.

FIG. 1 is a longitudinal cross-sectional view illustrating an LED head and a photosensitive drum in a first embodiment of the present application, and FIG. 3 is a lateral cross-sectional view illustrating an LED head and a photosensitive drum in a first embodiment of the present application.

The positional relationship between the photosensitive drum 23 (23-1 to 23-4) and the LED head unit 25 (25-1 to 25-4) is the same in the above-described image forming units 22 (22-1 to 22-4) shown in FIG. 2.

The LED head unit 25 includes an LED head 60 (as an exposure device), coil springs 69-1 and 69-2, and spacers 70-1 and 70-2. The LED head 60 includes a rod lens array (hereinafter, maybe referred to as "SLA") 62, a holder 61 that supports the lens array 62, an LED array chip 65, a substrate 66 on which the LED array chip 65 is installed, a base 67 that holds the substrate 66, and shielding plates 68-1 and 68-2 that shields light and foreign bodies from entering inside the LED head 62. The LED head 60 is arranged to face the photosensitive drum 23 via the spacers 70-1 and 70-2, and a downward pressing force is applied thereto by the coil springs 69-1 and 69-2.

The spacers 70-1 and 70-2, which are separation members, maintain a distance between the LED head 60 and the surface of the photosensitive drum 23 constant. The coil springs 69-1 and 69-2, which are pressing members, press the LED head 60 in a direction toward the photosensitive drum 23.

The LED array chips 65, which are a plurality of light emitting elements, are configured from LED chips in an array form. The substrate 66 is a rectangular glass epoxy substrate on which the LED array chips 65 are mounted. The substrate 66 is adhered to the base 67 by an adhesive 80 (80-1, 80-2, 80-3, 80-4, see FIG. 4), which is a first adhesive member, applied on a surface 66*a* of the substrate 66 that is on the opposite side from the surface on which the LED array chips 65 are mounted.

The base 67, which is a holding member, is a U-shaped steel plate having an opened upper part. The base 67 includes a substrate holding surface 67*a* as a substrate holding part on which the substrate 66 is fixed by the adhesive 80. In addition, the base 67 includes holder adhesion surfaces 67*b* as supported parts that are fixed to the holder 61.

The lens array 62, which is an optical system, is held and fixed at a lower part of the holder 61 and converges light irradiated from each LED array chip 65 onto a photosensitive surface 63, which is a surface of the photosensitive drum 23.

Figure 6:
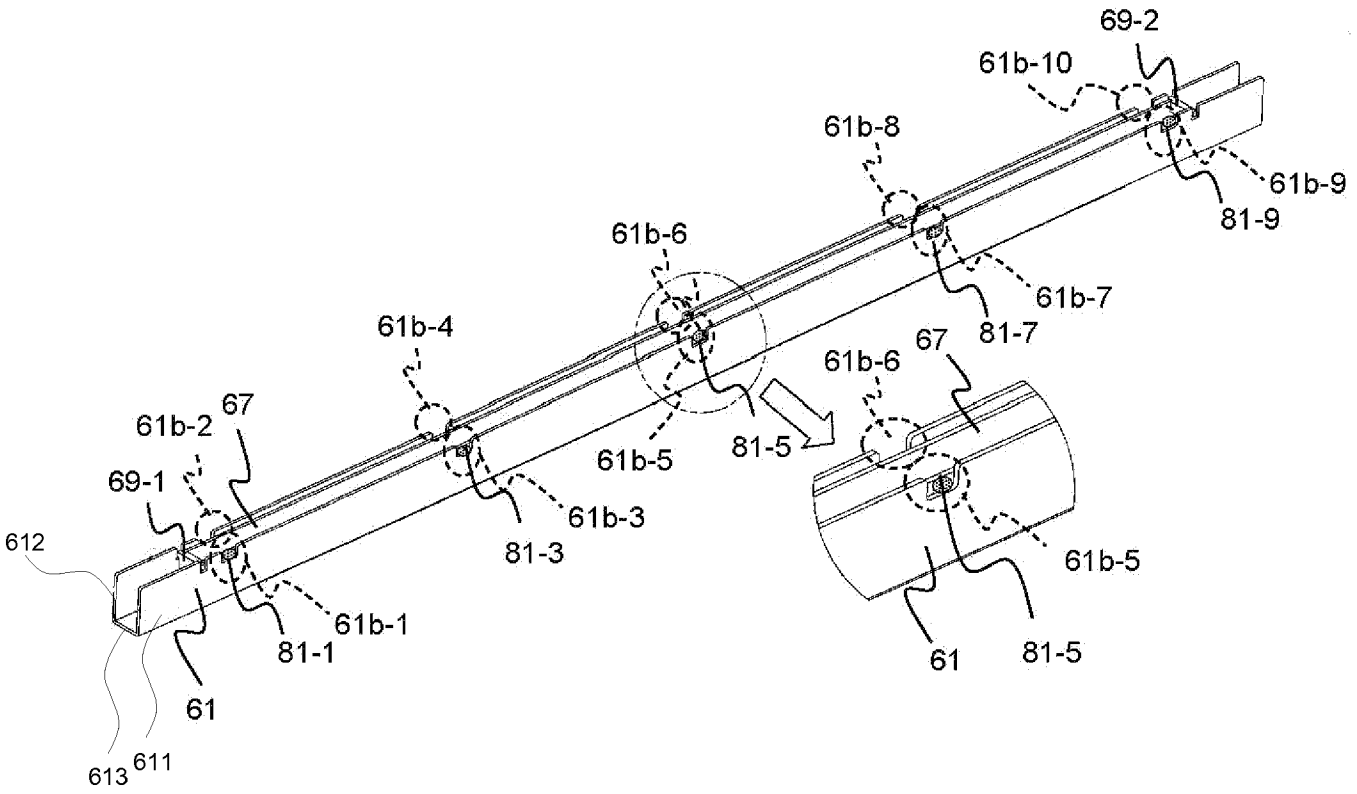
FIG. 6 is a perspective view illustrating adhesion between the base and a lens holder in the first embodiment of the present application.

The holder 61, which is a support member, holds and fixes the lens array 62 at a lower part thereof and supports the substrate 66 by holding and fixing the holder adhesion surface 67*b* of the base 67 by an adhesive 81, which is a second adhesive member. The holder 61 is configured from an substantially U-shaped steel plate and includes an opening 61 d at a bottom (lower) part thereof in which the lens array 62 is held and fixed. Moreover, the upper part of the holder 61 is open and includes five pairs of notches (adhesive member arrangement parts) 61*b* on both sides on the upper part. The notches 61*b*-2, 61*b*-4, 61*b*-6, 61*b*-8 and 61*b*-10 shown in FIG. 1 are formed on the back side upper part of the holder 61. On the front side upper part of the holder 61, notches 61*b*-1, 61*b*-3, 61*b*-5, 61*b*-7 and 61*b*-9 shown in later-discussed FIG. 6 are formed. The opening 61*d* is formed in the bottom part of the holder 61 along the longitudinal direction (X-direction) of the holder 61.

A distance Li is a distance from a light exit end surface of the lens array 62 to the surface of the photosensitive drum 23 when a lower surface 61*a* of the holder 61 contacts the space 70 provided on the surface of the photosensitive drum 23 at both ends. A distance Lo is a distance from the surface 65*x* of the LED array chip 65 to the light entrance end surface 62*x* of the lens array 62. See FIG. 3. With the lens array 62 of the first embodiment, the light that exits from the LED array chip 65 converges on the surface of the photosensitive drum 23 though the lens array 62 when the distance Li and the distance Lo are equal.

A sealant 82 is applied in a space between the lens array 62 and the holder 61 to seal the space. The sealant 82 prevents light and foreign bodies from entering into the space between the lens array 62 and the holder 61.

A sealant 83 is applied in a space between the base 67 and the holder 61 to seal the space. The sealant 83 prevents light and foreign bodies from entering into the space between the base 67 and the holder 61.

The shielding plates 68-1 and 68-2 are provided at both end parts of the base 67 in the longitudinal direction. The shield plates 68-1 and 68-2 prevent light and foreign objects from entering through both ends of the holder 61.

The coil springs 69, which are pressing members, are arranged near both end parts of the holder 61. The coil springs 69 biases the LED head 60 downwardly, which is in a direction toward the photosensitive drum 23. By biasing the lower surface 61*a* of the holder 60 against a contact surface of the spacers 70, the distance Li from the light exit end surface of the lens array 62 to the surface of the photosensitive drum 23 is maintained constant.

There has been a problem that the light that exists from the lens array 62 does not converge onto the surface of the photosensitive drum 23 when the substrate 66, the holder 61, the base 67 and the lens array 62 thermally expand and are displaced from appropriate positions due to a change in environmental temperature or when the substrate 66, the holder 61, the base 67 and the lens array 62 are displaced from the appropriate positions due to an external force, if the substrate is adhered to, held and fixed on the holder 61 using an adhesive.

Figure 4:
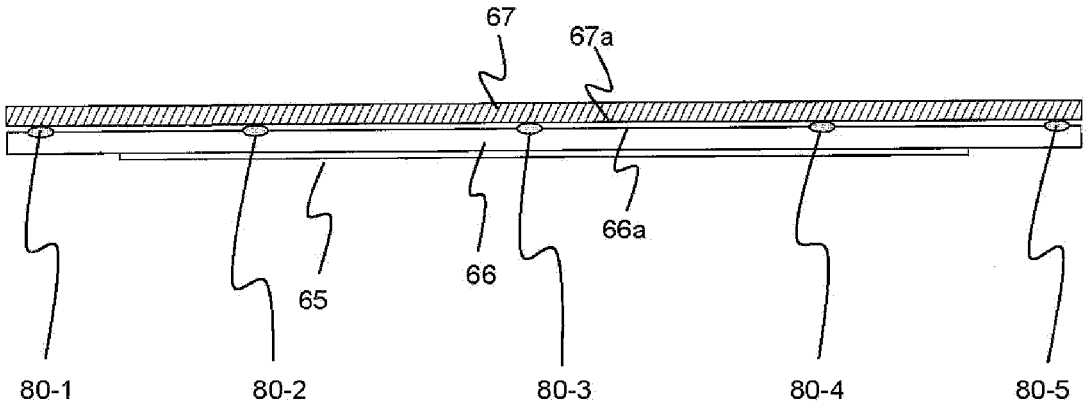
FIG. 4 is a longitudinal cross-sectional view illustrating adhesion between a substrate and a base in the first embodiment of the present application.

FIG. 4 is a longitudinal cross-sectional view illustrating adhesion between a substrate and a base in the first embodiment of the present application. The base 67 and the substrate 66 are adhered, held and fixed to each other by the adhesive 80 (80-1 to 80-5) between the surface 66*a* of the substrate 66, which is a surface opposite from the surface on which the LED array chips 65 are mounted, and the contact surface 67*a* of the base 67 at five locations in the longitudinal direction.

The adhesive 80 of the present first embodiment is an acrylic adhesive in which elongation is 45-70% and the hardness (Shore D) is 60-70.

The elongation of the adhesive 80 uses a value measured by a tension speed of 200 mm/min. using a test piece of HS No. 2 dumbbell based on a tension test (JIS K7113) for metal.

The hardness (Shore D) of the adhesive 80 is measured by pressing a pushpin, which is an indenter, into, and deforming, the surface of the hardened adhesive 80, which is a test piece, and by measuring an amount of deformation by the pressing. For the method for measuring the hardness, the "durometer hardness" that uses a spring and the "international rubber hardness degree (IRHD)" that uses a certain static load using a weight or the like may be used. Moreover, for JIS K6253-1997, which is a standard for a rubber hardness test, three types of durometer are provided that are used properly depending on the hardness of the measured object.

The hardness of the adhesive 80 is measured by placing the hardened adhesive 80, which is the test piece, on a pressure surface and by pushing the pushpin on the surface of the test piece towards the pressure surface. The pushpin penetrates into, and deforms, the test piece by the spring force. The penetration stops when the spring force and the elastic force of the test piece are balanced. The pushpin movement amount at this time defines the "hardness" of the test piece. The pushpin movement amount is amplified by a displacement amplification mechanism using a gear or the like and is read as a "hardness" value by a dial or the like.

No units are added to the measured value of hardness obtained by the durometer. There are types of durometers corresponding to the hardness of measured objects. The different shapes of pushpins and sprint loads are standardized depending on the types. The measured value of hardness is a numerical value of the hardness as a relatively comparative value for each type. In the first embodiment, a type D durometer for high hardness is used for measuring the hardness.

To reduces errors of the image forming position by light from the LED head 60 with respect to the surface of the photosensitive drum 23, the substrate 66 needs to be arranged while the substrate 66 has a highly precise straightness in the longitudinal direction. Therefore, the substrate 66 is adhered, held and fixed in the base 67 in a state where a straightness deviation is highly precisely produced in the longitudinal direction.

Figure 5:
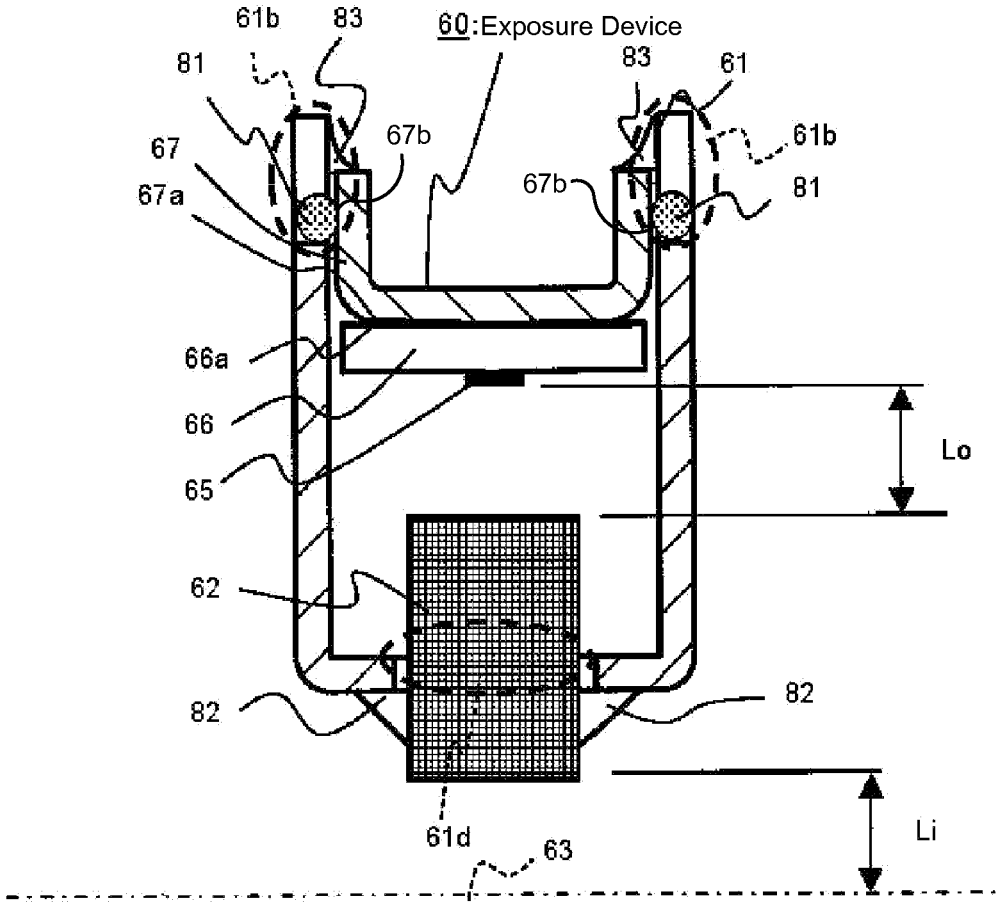
FIG. 5 is a perspective view illustrating adhesion between the base and a lens holder in the first embodiment of the present application.

FIG. 5 is a lateral cross-sectional view illustrating adhesion between the base and a lens holder in the first embodiment of the present application. FIG. 6 is a longitudinal cross-sectional view illustrating adhesion between the base and a lens holder in the first embodiment of the present application.

As shown in FIG. 6, the holder 61 is slender and in a substantially U-shape in a sectional view. The U-shape is formed with two side walls 611 and 612 and one bottom part 613. The holder 61 includes 10 notches 61*b* (61*b*-1 to 61*b*-10) that are adhesive injection parts on both of the side walls 611 and 612. Five pairs of the notches 61*b* are provided in the left-right side walls symmetry at equal intervals along the longitudinal direction. The notches 61*b*-2, 61*b*-4, 61*b*-6, 61*b*-8 and 61*b*-10 are formed on the back side upper part of the holder 61. The notches 61*b*-1, 61*b*-3, 61*b*-5, 61*b*-7 and 61*b*-9 are formed on the front upper part of the holder 61.

The adhesives 81-1, 81-3, 81-5, 81-7 and 81-9 and the adhesives 81-2, 81-4, 81-6, 81-8 and 81-10 (not shown) that are respectively injected into the notches 61*b* (61*b*-1 to 61*b*-10) adhere the holder 61 and the base 67 to hold and fix the base 67 in the holder 61.

(Operation of First Embodiment)Print operations of the image forming device 10 are described based on FIG. 2.

The recording sheet 100 is carried from the upstream side to the downstream side along the carrying path 101. The sheet storage cassette 110 is on the most upstream side, and the stacker 55 is on the most downstream side.

The image forming device 10 is connected to a host device (not shown) though a cable or a wireless communication. When a print instruction is received by receiving a transfer of print data from the host device, a pickup motor (not shown) rotates the hopping roller 12. A plurality of the recording sheets 100 is separated into each sheet and carried to the downstream side of the carrying path 101. Four image forming units 22 (22-1 to 22-4) are provided in the order of black (K), yellow (Y), magenta (M) and cyan (C) from the right hand side of the figure. Each image forming part 22 (22-1 to 22-4) starts rotation of the rollers substantially at the same time as the commencement of the sheet supply. The photosensitive drum 23 is rotated for one or more revolutions until the recording sheet 100 reaches the photosensitive drum 23.

When the motor (not shown) rotates the sheet supply roller 13*a*, the retard roller 13*b* that is in contact with the sheet supply roller 13*a* is driven in accordance with rotation of the sheet supply roller 13*a*. The recording sheet 100 carried from the hopping roller 12 is pinched and carried by the sheet supply roller 13*a* and the retard roller 13*b* and turns on the sheet supply sensor 14. Thereafter, the recording sheet 100 is carried to the registration rollers 15*a* and 15*b* on the downstream side of the carrying path 101 and turns on the write position sensor 16. Exposure by the LED head units 25 in the image forming units 22 in the respective colors of black (K), yellow (Y), magenta (M) and cyan (C) start in a certain amount of time after the write position sensor 16 turns on, and electrostatic latent images that correspond to the respective colors are formed on the respective photosensitive drums 23.

The recording sheet 100 is carried to the carrying belt 30 on the downstream side along the carrying path 101. When the roller 31 rotates, the carrying belt 30 that bridges the rollers 31 and 32 are driven along the carrying path 101. The recording sheet 100 is sequentially carried to the image forming units 22 arranged in the order of black (K), yellow (Y), magenta (M) and cyan (C) by the driving of the carrying belt 30.

The photosensitive drum 23 in each of the image forming units 22 for black (K), yellow (Y), magenta (M) and cyan (C) rotates in the clockwise direction, and the surface is first uniformly charged by the charging roller 24. The LED head unit 25 irradiates light to the uniformly charged photosensitive drum 23 based on the image information received from the host device to form an electrostatic latent image. The photosensitive drum 23, on which the electrostatic image has been formed, develops a toner image by the toner supply roller 27 and the development roller 26. The photosensitive drum 23, on which the toner image has been developed, pinches the carrying belt 30 and the recording sheet 100 with the transfer roller 21. Moreover, the photosensitive drum 23 attracts the toner on the photosensitive drum 23 to the recording sheet 100 side by the voltage of +1,000 V to +3,000 V applied to the transfer roller 21 and thereby causes the toner image to transfer onto the recording sheet 100. The recording sheet 100, onto which the toner image has been transferred, is sent to the fuser 40 where the toner image is fixed. The toner that remains on the photosensitive drum 23 is scraped off by the cleaning device (not shown) and provided to form a new toner image.

The recording sheet 100, onto which respective toner images of the colors of black (K), yellow (Y), magenta (M) and cyan (C) have been transferred, is pinched and carried through a nip region formed by the fusion roller 41 and the backup roller 42 in the fusser 40. Heat from the fusion roller 41 and pressure by a bias force of the backup roller 42 are added to the recording sheet 100 in the nip region. The toner images are fixed as the toners are fused.

A front end of the recording sheet 100, on which the toner images have been fixed, is detected by the sheet guideway sensor 51 and is carried by the rotation of the ejection rollers 52*a* and 52*b*. The recording sheet 100 that is carried is ejected to the stacker 55.

An assembly method of the LED head 60 of the first embodiment is explained based on FIGS. 1 and 3. The lens array 62 of the first embodiment is configured such that the light that exits from the LED array chip 65 converges on the surface of the photosensitive drum 23 though the lens array 62 when the distance Li and the distance Lo are equal.

The lens array 62 is inserted into the opening 61*d* of the holder 61. After a position of the lens array 62 is adjusted so that the distance between the lens array 62 and the photosensitive drum 23 becomes the predetermined distance Li, the lens array 62 and the holder 61 is adhered, held and fixed to each other by the adhesive (not shown). Thereafter, to prevent entry of light and foreign bodies into the holder 61, the space between the holder 61 and the lens array 62 is sealed by the sealant 82.

Next, the base 67 that holds the substrate 66 is inserted from the top part of the holder 61. In a state where adjustments are made such that the distance Lo and the distance Li are equalized and that the center of the lens array 62 and the optical axis of the LED array chip 65 match, the base 67 is adhered, held and fixed to the holder 61.

An operation for adhering the base 67 and the holder 61 of the first embodiment is explained based on FIGS. 5 and 6. The base 67, to which the substrate 66 is adhered, is inserted from the top part of the holder 61 to which the lens array 62 is adhered. An adjustment is made so as to maintain the straightness deviation of the substrate 66 adhered to the holder 61. In addition, the distance Lo is adjusted to a position so as to be equalized with the distance Li. Moreover, an adjustment is made to match the center of the lens array 62 and the optical axis of the LED array chip 65. With such adjustments, the adhesive 81 is injected into the five pairs of notches 61*b* formed on both side surfaces of the holder 61 to adhere, hold and fix the base 67 and the holder 61 to each other. Thereafter, the sealant 83 is applied into the space between the base 67 and the holder 61 from the top side. The sealant 83 hardens as time elapses and seals the space. The sealant 83 is prevents light and foreign bodies from entering into the space between the base 67 and the holder 61. For the application of the sealant 83 of the first embodiment, there is a case where the sealant 83 leaks from the notches 61*b* to the side surface part of the holder 61 when the sealant 83 is applied in the space between the base 67 and the holder 61.

In the first embodiment, the base 67 that holds the substrate 66 and the holder 61 that supports the base 67 are configured from the same material, which is steel. Therefore, the difference in linear expansion coefficients of the base 67 and the holder 61 is within a range of ±5%. That is, the linear expansion coefficient of the base 67 is about 95 to 105% of the linear expansion coefficient of the holder 61. Thus, when the base 67 and the holder 61 are adhered, held and fixed to each other, the difference in expansion/contraction due to the difference in the linear expansion coefficients is not considered a problem even if the environmental temperature changes.

To the adhesive 81 that adheres, holds and fixes the bases 67 and the holder 61, a stress due to the difference in the expansion/contraction of the base 67 and the holder 61 is not generated. Therefore, a problem, such as pealing of the adhesive 81 and the like, does not occur. Therefore, in the first embodiment, the base 67 and the holder 61 are strongly adhered, held and fixed to each other by the adhesive 81 that has low elongation and high hardness. The LED head 60 and the LED head unit 25 of the first embodiment are capable of stably supporting the base 67 and the holder 61 even if an external force or the like applies at the time of handling the LED head 60 and the LED head unit 25. Further, the distance Lo between the surface of the LED array chip 65 and the light entrance end surface of the lens array 62 can be stably maintained.

In the meantime, the substrate 66 is generally configured from a material composed of glass epoxy. The base 67 and the substrate 66 are of different materials and may have different linear expansion coefficients. In general, the linear expansion coefficient of glass epoxy is 8 to 20 PPM/° C., and the linear expansion coefficient of steel is 12 PPM/° C. At this time, the linear expansion coefficient of the substrate 66 is about 66 to 166% of the linear expansion coefficient of the base 67. In the first embodiment, the linear expansion coefficient of the substrate 66 made of glass epoxy is 9 PPM//° C. The linear expansion coefficient of the base 67 and the holder 61 that are made of steel is 11.7 PPM//° C. At this time, the linear expansion coefficient of the substrate 66 is 77% of the linear expansion coefficient of the base 67.

Therefore, when the environmental temperature changes, an expansion/contraction difference occurs between the base 67 and the substrate 66, causing a case that a stress is generated due to the expansion/contraction difference. By this stress, warping of the substrate 66 occurs, resulting in possible pealing of the adhesive 80.

Figure 7C:
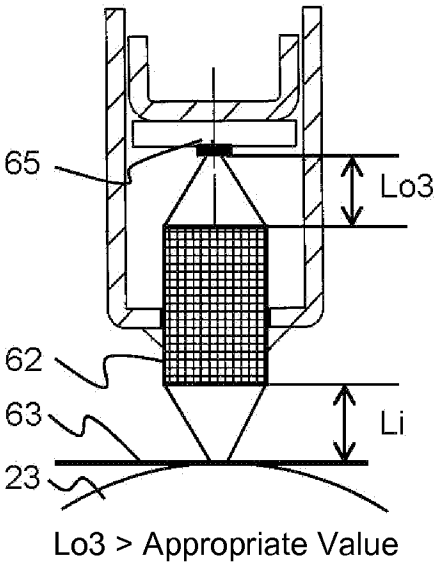
FIGS. 7A-7C are lateral cross-sectional views illustrating convergence of light by an SLA in the first embodiment of the present application.
Figure 7B:
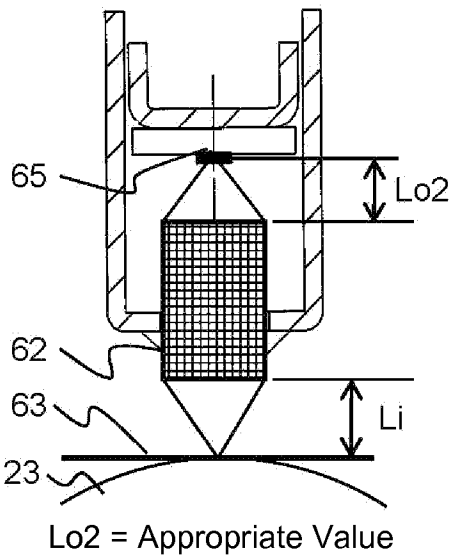
Figure 7A:
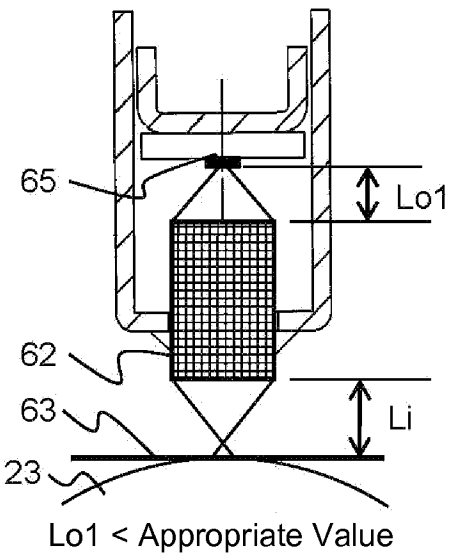

FIGS. 7A-7C are lateral cross-sectional views illustrating convergence of light by an SLA in the first embodiment of the present application.

In the image forming device 10, the distance Lo needs to be an appropriate value to obtain good printing results.

FIG. 7A illustrates a case in which the distance Lo1 is smaller than the appropriate value. At this time, the light converges before the photosensitive surface 63 that is the surface of the photosensitive drum 23. Therefore, an accurate image is not formed on the photosensitive surface 63.

FIG. 7B illustrates a case in which the distance Lo2 is at the appropriate value. At this time, the light converges at the photosensitive surface 63 that is the surface of the photosensitive drum 23. Therefore, an accurate image is formed on the photosensitive surface 63.

FIG. 7C illustrates a case in which the distance Lo3 is larger than the appropriate value. At this time, the light does not converge at the photosensitive surface 63 that is the surface of the photosensitive drum 23. Therefore, an accurate image is not formed on the photosensitive surface 63.

In the image forming device 10, the distance Li, in addition to the distance Lo, needs to be an appropriate value to obtain good printing results. That is, the substrate 66 and the lens array 62 need to be configured to be within appropriate positions.

For example, when the substrate 66 is displaced by 30 μm below the appropriate position of the substrate 66, and when the lens array 62 is displaced by 10 μm above the appropriate position of the lens array 62, the light ejected from the lens array 62 converges at 40 μm above the photosensitive surface 63 that is the surface of the photosensitive drum 23.

The displacement of the substrate 66 and the lens array 62 from the appropriate positions thereof could also occur by the thermal expansion due to the change in the environmental temperatures. To obtain good printing results even with the change in the environmental temperature, an acceptable range of an amount of warping of the substrate 66 in the longitudinal direction is within 10 μm. The smaller the amount of warping the better.

Further, to obtain good printing results, the offset between the center of the lens array 62 and the optical axis of the LED array chip 65 needs to be within the acceptable range. In the first embodiment, to obtain good printing results even with the change in environmental temperature, the acceptable range of warping of the substrate 66 on which the LED array chip 65 is mounted is within ±20 μm.

Figure 8:
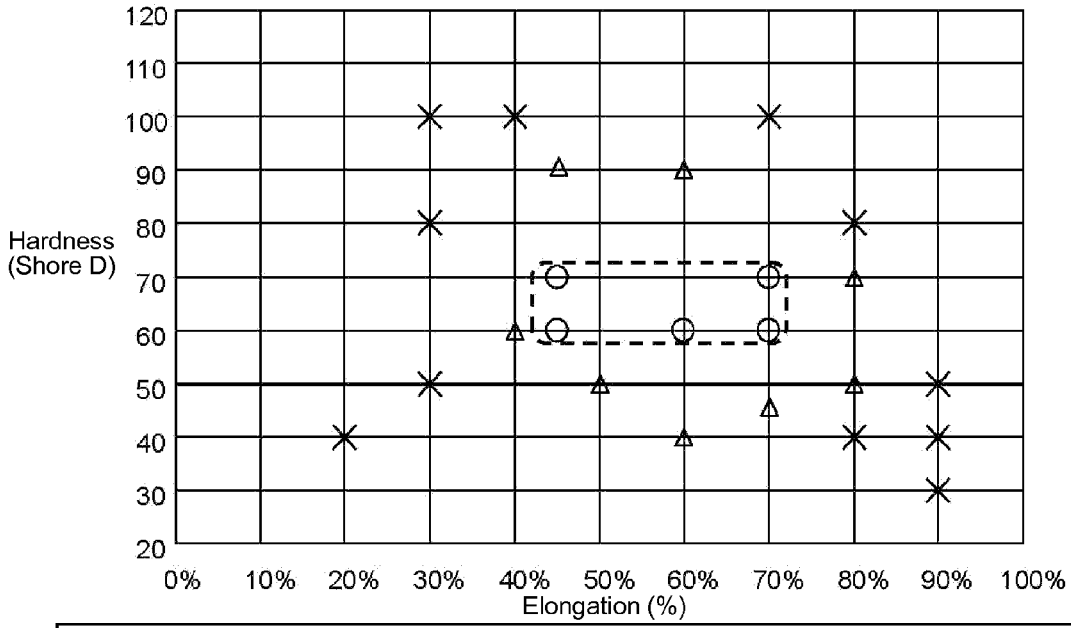
FIG. 8 illustrates test results of a relationship between elongation and hardness (Shore D) of a substrate adhesive.

FIG. 8 illustrates test results of a relationship between elongation and hardness (Shore D) of a substrate adhesive. The horizontal axis indicates elongation (%), and the vertical axis indicates hardness (Shore D).

"○" in the drawing indicates a case where the warping of the substrate 66 is 0 to 10 μm in the longitudinal direction and 0 to 22 μm in the lateral direction. "Δ" in the drawing indicates a case where the warping of the substrate 66 is 0 to 30 μm in the longitudinal direction and 20 to 30 μm in the lateral direction. "x" in the drawing indicates a case where the warping of the substrate 66 is 20 μm or more in the longitudinal direction and 30 μm or more in the lateral direction.

The base 67 used in this test is configured from an electrogalvanized steel plate (linear expansion coefficient: 11.7 PPM/° C.) having a thickness of 0.6 mm as a base material and has a U-shape with a length of 2.80 mm, a width of 8 mm and a height of 3.5 mm) The substrate 66 is configured from glass epoxy (linear expansion coefficient: 9 PPM/° C.) as a base material and has a shape with a length of 1.6 mm, a length of 280 mm and a width of 7 mm. The adhesive 80 used is an acrylic adhesive, which is an ultraviolet-hardening type UV adhesive and in which a glass filler and the like are filled as components. The elongation and hardness (Shore D) are changed by adjusting the amount of the filler in the adhesive 80. The elongation of the adhesive 80 is changed by adjusting the component of the acrylic base material (e.g., acrylate monomer). The hardness (Shore D) of the adhesive 80 is controlled by the amount of glass filler component.

From the test results, the adhesive 80, which meets the condition that the warping of the substrate 66 is 10 μm or less in the longitudinal direction and 20 μm or less in the lateral direction, has elongation of 45 to 70% and hardness (Shore D) of 60 to 70.

A case is explained in which, for example, the substrate 66 and the base 67 are strongly adhered with each other with the adhesive 80 having elongation of 10 to 30% and hardness (Shore D) of 90 to 100. When substrate 66 and the base 67 are placed under a high temperature environment by increasing the environmental temperature from 20° C. to 70° C. (Δ50° C.), a bimetal effect in which the entire body of the substrate warps due to the difference in the linear expansion coefficients of the substrate 66 and the base 67. Due to this bimetal effect, warping of more than 10 μm is generated on the substrate 66.

A case is explained in which, for example, a soft adhesive having elongation of 80 to 90% and hardness (Shore D) of 30 to 50 is used as the adhesive 80. When substrate 66 and the base 67 are similarly placed under the high temperature environment by increasing the environmental temperature from 20° C. to 70° C. (Δ50 ° C.), the bimetal effect was reduced, and the warping of the substrate 66 in the longitudinal direction is controlled to 10 μm or less. However, in this case, the substrate 66 warps by more than 20 μm in the lateral direction. This warping in the lateral direction is generated due to positions of through holes provided on the substrate 66 and balance of positions of copper films. Therefore, the substrate 66 is not sufficiently maintained with the soft adhesive.

In the first embodiment, steel plates with similar materials are used for the base 67 and the holder 61 so that the linear expansion coefficients of the base 67 and the holder 61 are equalized. As the adhesive 80 that is a first adhesive member that fixes the substrate 66 and the base 67, an adhesive with elongation of 45 to 70% and hardness (Shore D) of 60 to 70 is used. Moreover, as the adhesive 81 that is a second adhesive member that fixes the base 67 and the holder 61, an adhesive with elongation of 10 to 30% and hardness (Shore D) of 90 to 100 is used. With this configuration, the substrate 66 is stably held in the holder 61 against the change in environmental temperature. In addition, even with disturbance, the substrate 66 is stably held in the holder 61.

(Advantages of First Embodiment) According to the LED head 60, the LED head unit 25 and the image forming device 10 of the first embodiment, there are the following advantages (A) and (B):

(A) Warping of the substrate is suppressed within an acceptable range despite a change in environmental temperature, and the substrate 66 is stably held in the holder 61. The distance Lo from the LED array chip 65 that is mounted on the substrate 66 and ejects light to the light entrance end surface of the lens array 62 and a positional relationship of the center of the lens array 62 and the optical axis of the LED array chip 65 are stably maintained. Therefore, the image forming device 10 is provided that is capable of performing highly reliable and precise printing.

(B) The adhesive 81 that adheres, holds and fixes the base 67 and the holder 61 has low elongation and high hardness and strongly adheres, holds and fixes the base 67 and the holder 61. As a result, the LED head 60 and the LED head unit 25 are capable of stably supporting the base 67 and the holder 61 even if an external force or the like applies at the time of handling the LED head 60 and the LED head unit 25. Further, the distance Lo between the surface of the LED array chip 65 and the light entrance end surface of the lens array 62 can be stably maintained. Therefore, the image forming device 10 is provided that is capable of performing highly reliable and precise printing.

Figure 9:
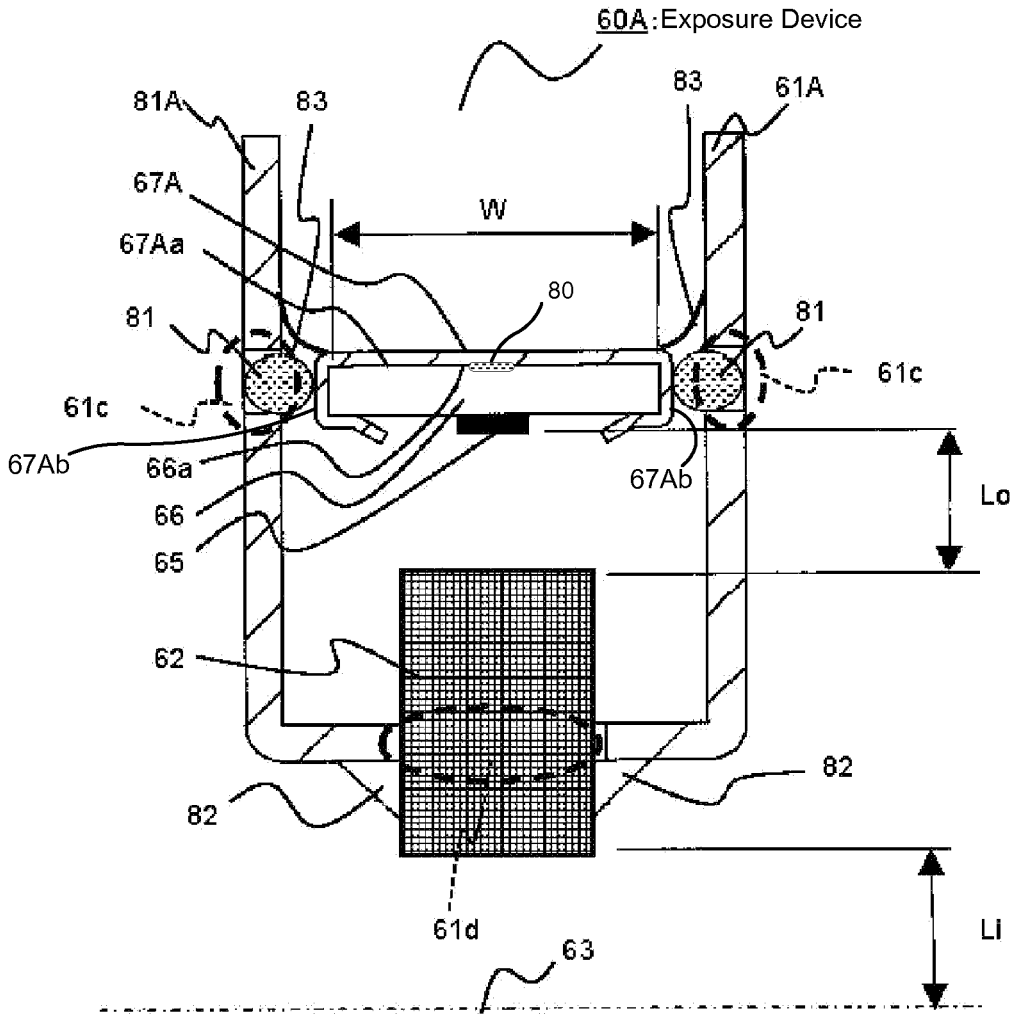
FIG. 9 is a lateral cross-sectional view illustrating adhesion between the base and the lens holder in the second embodiment of the present application.
Figure 10:
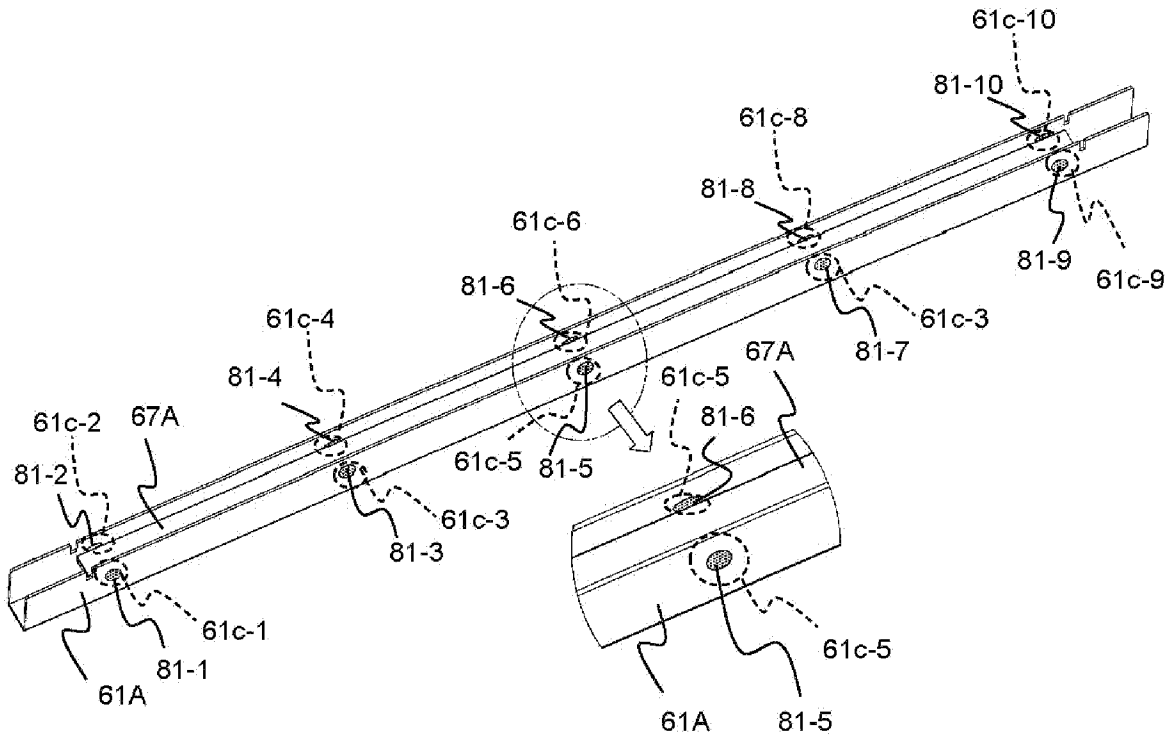
FIG. 10 is a perspective view illustrating adhesion between the base and the lens holder in the second embodiment of the present application.

Second Embodiment (Configuration of Second Embodiment) FIG. 9 is a lateral cross-sectional view illustrating adhesion of the base and the holder according to a second embodiment of the present application. Elements that are common with the elements shown in FIG. 5 that illustrates the first embodiment are referred to by the same symbols. FIG. 10 is a lateral cross-sectional view illustrating adhesion of the base and the holder according to a second embodiment of the present application. Elements that are common with the elements shown in FIG. 6 that illustrates the first embodiment are referred to by the same symbols.

The LED head unit 25A of the second embodiment includes an LED head 60A (as an exposure device) that is different from the first embodiment and a configuration similar to the LED head unit 25 of the first embodiment for other parts. The LED unit 25A is installed in an image forming device 10A.

The LED head 60A of the second embodiment includes a base 67A and a holder 61A that are different from the first embodiment and a configuration similar to the LED head 60 of the first embodiment for other parts.

The base 67A of the second embodiment is different from the base 67 of the first embodiment in that the base 67A is configured from steel plates formed to surround the periphery of the substrate 66 and cover the surface of the substrate 66, on which the LED array chip 65 is mounted, to both sides in the lateral direction. The base 67A has substantially the same length as the substrate 66. A width W of the base 67A in the lateral direction is substantially equal to a width of the substrate 66 in the lateral direction. On the inner surface of the base 67A, a substrate holding surface 67Aa is formed as a substrate holding part on which the substrate 66 is fixed. In addition, on the outer surface of the base 67A, holder adhesion surfaces 67Ab are formed as supported parts that are fixed to the holder 61A The substrate 66 and the base 67A are adhered, held and fixed to each other at five locations in the longitudinal direction via the acrylic adhesive 80 having the elongation of 45 to 70% and the hardness (Shore D) of 60 to 70.

Unlike the holder 61 of the first embodiment, the holder 61A of the second embodiment includes ten holes (adhesive member arrangement parts) 61*c* (61*c*-1 to 61*c*-10) that are adhesive injection parts, instead of the notches 61*b*. Other parts are similar to the holder 61 of the first embodiment. Five pairs of the holes 61*c* are provided in the left-right symmetry at equal intervals along the longitudinal direction.

The adhesives 81 (81-1 to 81-10) that are injected into the holes 61*c* (61*c*-1 to 61*c*-10) adhere the holder 61A and the base 67A to hold and fix base 67A in the holder 61A.

(Operation of Second Embodiment) An operation for adhering the base 67A and the holder 61A of the second embodiment is explained based on FIGS. 9 and 10.

The base 67A, to which the substrate 66 is adhered, is inserted from the top part of the holder 61A, though which the lens array 62 is adhered. An adjustment is made so as to maintain the straightness deviation of the substrate 66 adhered to the holder 61A. In addition, the distance Lo is adjusted to a position so as to be equalized with the distance Li. Moreover, an adjustment is made to match the center of the lens array 62 and the optical axis of the LED array chip 65. With such adjustments, the adhesive 81 is injected into the five pairs of holes 61*c* formed on both side surfaces of the holder 61A to adhere, hold and fix the base 67A and the holder 61A. Thereafter, the sealant 83 is applied into the space between the base 67A and the holder 61A. The sealant 83 hardens as time elapses and seals the space. The sealant 83 prevents light and foreign bodies from entering into the space between the base 67A and the holder 61A. Unlike the holder 61 of the first embodiment, with the holder 61A of the second embodiment, the sealant 83 does not leak through the holes 61*c* to the side surface part of the holder 61A when the sealant 83 is applied in the space between the base 67A and the holder 61A. Therefore, there is an advantage in that the application process of the sealant 83 becomes easy.

In the second embodiment, similar to the first embodiment, the base 67A that holds the substrate 66 and the holder 61A that supports the base 67A are configured from the same material, which is steel. Therefore, the difference in linear expansion coefficients of the base 67A and the holder 61A is within a range of ±5%. Thus, similar to the first embodiment, when the base 67A and the holder 61A are adhered, held and fixed to each other, the difference in expansion/contraction due to the difference in the linear expansion coefficients is not considered a problem even if the environmental temperature changes.

To the adhesive 81 that adheres, holds and fixes the bases 67A and the holder 61A, a stress due to the difference in the expansion/contraction of the base 67A and the holder 61A is not generated. Therefore, a problem, such as peeling of the adhesive 81 and the like, does not occur. Therefore, in the second embodiment, similar to the first embodiment, the base 67A and the holder 61A are strongly adhered, held and fixed to each other by the adhesive 81 that has low elongation and high hardness.

As a result, similar to the first embodiment, the LED head 60A and the LED head unit 25A are capable of stably supporting the base 67A and the holder 61A even if an external force or the like applies at the time of handling the LED head 60A and the LED head unit 25A. Further, the distance Lo between the surface of the LED array chip 65 and the end surface of the lens array 62 to which light enters can be stably maintained.

Similar to the first embodiment, the substrate 66 of the second embodiment is generally configured from a material composed of glass epoxy. The base 67A and the substrate 66 are of different materials and may have different linear expansion coefficients. Therefore, when the environmental temperature changes, an expansion/contraction difference occurs between the base 67A and the substrate 66, causing a stress is generated due to the expansion/contraction difference. By this stress, warping of the substrate 66 occurs, resulting in possible peeling of the adhesive 80.

Similar to the first embodiment, the substrate 66 is in a state where a highly precise straightness of the substrate 66 is maintained relative to the longitudinal direction of the holder 61A and where a straightness deviation is highly precisely produced in the longitudinal direction. Furthermore, the substrate 66 and the base 67A are adhered, held and fixed to each other at five locations in the longitudinal direction in the substrate holding surface 67Aa of the base 67A via the acrylic adhesive 80 having the elongation of 45 to 70% and the hardness (Shore D) of 60 to 70.

As described in the first embodiment, the warping in the longitudinal direction with respect to the change in the environmental temperature is controlled within 10 μm. Moreover, an inner width W of the base 67A in the lateral direction and a width of the substrate 66 in the lateral direction are configured substantially equal to each other. Therefore, even when a change is made in the substrate 66 in the lateral direction due to the change in the environmental temperature, the warping of the substrate 66 is controlled because the inner surface of the base 67A restricts the change of the substrate 66 in the lateral direction.

The material of the base 67A that holds the substrate 66 and the material of the holder 61A that supports the base 67A are configured from the same material formed from steel. In addition, the base 67A and the holder 61A are adhered, held and fixed to each other. Therefore, similar to the first embodiment, the difference in expansion/contraction due to the difference in the linear expansion coefficients does not occur between the base 67A and the holder 61A even against the change in the environmental temperature. Therefore, the base 67A and the holder 61A are strongly adhered, held and fixed to each other by the adhesive 81 that has high hardness.

The LED head 60A and the LED head unit 25A of the second embodiment are capable of stably supporting the base 67A and the holder 61A even if an external force or the like applies at the time of handling the LED head 60A and the LED head unit 25A. Further, the distance Lo between the surface of the LED array chip 65 and the light entrance end surface of the lens array 62 can be stably maintained.

(Advantages of Second Embodiment) According to the LED head 60A, the LED head unit 25A and the image forming device 10A of the second embodiment, there are the following advantages (C) and (D):

(C) For the change in the environmental temperature, warping of the substrate in the longitudinal direction is 10 μm or less, and warping in the lateral direction is less than the first embodiment. Therefore, it is expected that the substrate 66 is stably held in the holder 61A. In addition, the distance Lo from the LED array chip 65 that is mounted on the substrate 66 and ejects light to the light entrance end surface of the lens array 62 and a positional relationship of the center of the lens array 62 and the optical axis of the LED array chip 65 are stably maintained. Therefore, the image forming device 10A is provided that is capable of perform highly reliable and precise printing.

(D) Unlike the holder 61 of the first embodiment, with the holder 61A of the second embodiment, the sealant 83 does not leak through the holes 61*c* to the side surface part of the holder 61A when the sealant 83 is applied in the space between the base 67A and the holder 61A. Therefore, there is an advantage in that the application process of the sealant 83 becomes easy.

(Exemplary modifications) The above-described embodiments are not limited to the above-described configurations, and other various forms and modifications are possible. The following (a) to (d) are examples of such forms and exemplary modifications.

(a) In the first and second embodiments, the image forming devices 10 and 10A, which are tandem printing devices, are explained as examples. However, the embodiments are not limited to these and may be used in other types of printing devices.

(b) The first and second embodiments are explained with the image forming devices 10 and 10A as printer devices, as examples. However, the embodiments are not limited to these and may be used in image forming devices other than printers, such as photocopy machines, facsimile machines and multi-functional machines.

(c) The first embodiment is explained with an acrylic adhesive as the adhesives 80 and 81, as an example. However, the adhesive is not limited to this and may be other adhesives, such as a polyurethane adhesive, an α-olefinic adhesive, an ether cellulose adhesive, an ethylene-vinyl acetate resin adhesive, a polyvinyl chloride solvent adhesive, a chloroprene rubber adhesive, a cyanoacrylate adhesive, silicone adhesive, styrene-butadiene rubber adhesive, a nitrile rubber adhesive, a cellulose nitrate adhesive, a phenolic adhesive, a polyimide adhesive, a polyvinyl alcohol adhesive, a urea resin adhesive, a polymethacrylate resin adhesive, a resorcinol resin and the like, that has the elongation and hardness (Shore D) similar to the first and second embodiments.

(d) In the case of the first embodiment, the substrate 66 and the base 67, which is a holding member, are adhered, held and fixed to each other via the acrylic adhesive 80 having the elongation of 45 to 70% and the hardness (Shore D) of 60 to 70. Thereafter, the base 67 is adhered, held and fixed to the holder, which is a support member, and the substrate 66 is supported in the holder 61. However, the configuration is not limited to this. The substrate 66 may be adhered, held and fixed to the holder 61, which is the support member, via a third adhesive having elongation of 45 to 70% and hardness (Shore D) of 60 to 70.

Moreover, the various numerical values described in the above embodiments are not strictly limited to those values unless specifically stated. Therefore, values near the respective numerical values that substantially result in the effects of the embodiments are also included in those values.

What is claimed is:

1. An exposure device, comprising:

a substrate on which a plurality of light emitting elements are mounted, the substrate having a linear coefficient of expansion;

an optical system that converges light irradiated from the light emitting elements onto a photosensitive surface;

a holding member that holds and fixes the substrate, the holding member having a linear coefficient of expansion different from the linear coefficient of expansion of the substrate;

a support member that supports the optical system and the holding member, the support member having a linear coefficient of expansion different from the linear coefficient of expansion of the substrate;

a first adhesive member that is provided between the substrate and the holding member; and a second adhesive member that is provided between the holding member and the support member, wherein the first adhesive member has higher elongation and lower hardness than the second adhesive member for reducing warping, in both longitudinal and lateral directions.

2. The exposure device according to claim 1, wherein the support member maintains the substrate and the optical system at a predetermined distance.

3. The exposure device according to claim 1, wherein the support member is formed in a substantially U-shape with two side surfaces and a bottom part therebetween in a sectional view, and an opening for supporting the optical system is provided at the bottom part.

4. The exposure device according to claim 1, wherein the support member includes an adhesive member arrangement part provided on a side surface thereof.

5. The exposure device according to claim 1, wherein the support member includes a plurality of adhesive member arrangement parts on side surfaces thereof.

6. The exposure device according to claim 1, wherein the holding member includes a substrate holding part that holds the substrate and supported parts that are supported by the support member.

7. The exposure device according to claim 6, wherein the holding part is formed in a substantially U-shape, the supported parts are formed on both side surfaces of the U-shape, and the substrate holding part is formed between the supported parts.

8. The exposure device according to claim 1, wherein the elongation of the first adhesive member is 45 to 70%, and the elongation of the second adhesive member is 10 to 30%.

9. The exposure device according to claim 1, wherein the hardness (Shore D) of the first adhesive member is 60 to 70, and the hardness (Shore D) of the second adhesive member is 90 to 100.

10. The exposure device according to claim 1, wherein the linear expansion coefficient of the substrate is 66 to 166% of the linear expansion coefficient of the holding member.

11. The exposure device according to claim 1, wherein the linear expansion coefficient of the holding member is 95 to 105% of the linear expansion coefficient of the support member.

12. An image forming device, comprising:

the exposure device of claim 1.

13. The exposure device according to claim 1, wherein the first adhesive includes a glass filler.

14. The exposure device according to claim 1, wherein the support member and the holding member are made of metal.

15. The exposure device according to claim I, wherein the support member and the holding member are made of steel.

16. The exposure device according to claim 1, wherein the substrate is made of resin.

17. The exposure device according to claim 1, wherein the substrate is a glass epoxy substrate.

18. An exposure device comprising:

a substrate on which a plurality of light emitting elements are mounted;

an optical system that converges light irradiated from the light emitting elements onto a photosensitive surface;

a holding member that holds and fixes the substrate;

a support member that supports the optical system and the holding member;

a first adhesive member that is provided between the substrate and the holding member; and a second adhesive member that is provided between the holding member and the support member, wherein:

the first adhesive member has higher elongation and lower hardness than the second adhesive member, the holding member includes a substrate holding part that holds the substrate and supported parts that are supported by the support member, the holding part is formed in a substantially U-shape, the substrate holding part is formed on an inner surface of the U-shape, and the supported parts are formed on an outer surface of the U-shape.

19. A light emitting diode (LED) head, comprising:

a substrate on which a plurality of light emitting elements are mounted, the substrate having a linear coefficient of expansion;

an optical system that converges light irradiated from the light emitting elements onto a photosensitive surface;

a holding member that holds and fixes the substrate, the holding member having a linear coefficient of expansion different from the linear coefficient of expansion of the substrate;

a support member that supports the optical system and the holding member, the support member having a linear coefficient of expansion different from the linear coefficient of expansion of the substrate;

a first adhesive member that is provided between the substrate and the holding member; and a second adhesive member that is provided between the holding member and the support member, wherein the first adhesive member has higher elongation and lower hardness than the second adhesive member for reducing warping in both longitudinal and lateral directions.

20. An image forming device, comprising:

the LED head of claim 19.

21. An exposure device, comprising:

a substrate on which a light emitting diode (LED) array chip is mounted, the LED array chip containing a plurality of LED elements, and the substrate having a linear coefficient of expansion;

an optical system including a rod lens array which faces the LED array chip and which converges light irradiated from the LED array chip onto a photosensitive surface;

a holding member that holds and fixes the substrate, the holding member having a linear coefficient of expansion different from the linear coefficient of expansion of the substrate;

a support member that supports the optical system and the holding member inside, the support member having a linear coefficient of expansion different from the linear coefficient of expansion of the substrate;

a first adhesive member that is provided between the substrate and the holding member; and a second adhesive member that is provided between the holding member and the support member, wherein the elongation of the first adhesive member is 45 to 70%, the hardness (Shore D) of the first adhesive member is 60 to 70, and the second adhesive member has lower elongation and higher hardness than the first adhesive member.

22. The exposure device according to claim 21, wherein the substrate and the optical system are provided in the support member such that the substrate and the optical system are maintained at a predetermined distance along the substantially entire length and width of the substrate and the optical system.

23. The exposure device according to claim 21, wherein the support member is slender and in a U-shape in a sectional view formed with a bottom part and two side walls, and is arranged along an axis of a photosensitive body having the photosensitive surface, both of the side walls of the support member have a plurality of adhesive member arrangement parts at predetermined intervals, and the second adhesive member is injected through the adhesive member arrangement parts so that the holding member is fixed to the support member.

* * * * *